US006559766B2

(12) United States Patent
Mohri

(10) Patent No.: US 6,559,766 B2
(45) Date of Patent: May 6, 2003

(54) IN-HOME SURVEILLANCE SYSTEM

(76) Inventor: Akiyoshi Mohri, 5-6-8, Nishi-okamoto, Higashinada-ku, Kobe-shi, Hyogo-ken (JP)

( * ) Notice: Subject to any disclaimer, the term of this patent is extended or adjusted under 35 U.S.C. 154(b) by 0 days.

(21) Appl. No.: 09/989,713

(22) Filed: Nov. 20, 2001

(65) Prior Publication Data

US 2002/0101347 A1 Aug. 1, 2002

(30) Foreign Application Priority Data

Feb. 1, 2001 (JP) ..... 2001-025920
Sep. 10, 2001 (JP) ..... 2001-273703

(51) Int. Cl.[7] ..... G08B 19/00

(52) U.S. Cl. ..... 340/521; 709/227; 709/218; 709/222; 709/239; 370/401; 370/486; 340/506; 340/521; 340/517; 340/3.1

(58) Field of Search ..... 709/227, 218, 709/222, 239; 370/401, 486; 340/506, 521, 517, 3.1

(56) References Cited

U.S. PATENT DOCUMENTS 5,894,479 A * 4/1999 Mohammed ..... 370/401
6,041,356 A * 3/2000 Mohammed ..... 709/227
6,157,965 A * 12/2000 Mohammed et al. ..... 710/8

* cited by examiner

*Primary Examiner*—Daryl Pope
(74) *Attorney, Agent, or Firm*—Katten Muchin Zavis Rosenman

(57) ABSTRACT

An in-home surveillance-system comprising duplex communication equipment installed in a cable television station, and a domestic cable modem installed in a contracting home and connected to a lifestyle utility meter for the integrated amount of electric energy, the integrated amount of gas flow, and the integrated amount of water flow, and capable of internet protocol communication as well as relaying cable television broadcasts, wherein the in-home surveillance-system performs automatic reading of the lifestyle utility usage for transmission through the internet communication to a first center, and detects the occurrence of anything unusual relating to the occupant, by full-time transmission, through the internet protocol communication, of at least one of lifestyle utility usage, cable television broadcast reception, and internet access from the domestic cable modem to a second center.

14 Claims, 1 Drawing Sheet

IN-HOME SURVEILLANCE SYSTEM

INDUSTRIAL FIELD OF APPLICATION

This invention relates to an in-home surveillance system.

BACKGROUND OF THE INVENTION

Heretofore, public rates readings have been carried out by a meter-reader visiting each house, reading the scale of each integrating meter and entering this reading into a terminal. From this data, invoices are created and sent out by mail.

However, the work of the meter-reader involves movement from door to door, and is far from efficient. There is thus the issue that the expense relating to the meter-reader forms one part of the fee that each household is responsible for.

In addition, in household security services, there is a system that detects a fire developing, or unusual vibrations in the doors or windows and so forth to automatically inform through a protocol using a telephone line.

However, the occupant has to operate the system from a terminal installed on the wall for example, and there is a problem in the case of a sudden illness or emergency. Specifically, there is a problem of a delay in informing the police or ambulance if the occupant is immobilized in incidents such as kidnaping or burglary, or has lost consciousness because of an unexpected illness, or if moving becomes difficult.

Internet is connected by way of the so-called dial-up connection only when required using the telephone line or ISDN line.

Because of deregulation, there is no boundary between broadcasting and communicating, and CATV which is conventionally used for broadcasting can be utilized for communicating. With the CATV, a coaxial cable is used in the broad range of frequency band, from 5 MHz to 1000 MHz. Optical fibers also can be utilized.

It is possible to utilize the broad range of frequency band in the full-time connection to the Internet.

SUMMARY OF THE INVENTION

In order to solve the above problems, it is an object of the invention to provide an in-home surveillance-system that can reliably ensure the safety of an occupant, with low cost and easy maintenance.

DETAILED DESCRIPTION OF THE PREFERRED EMBODIMENTS

Figure 1:
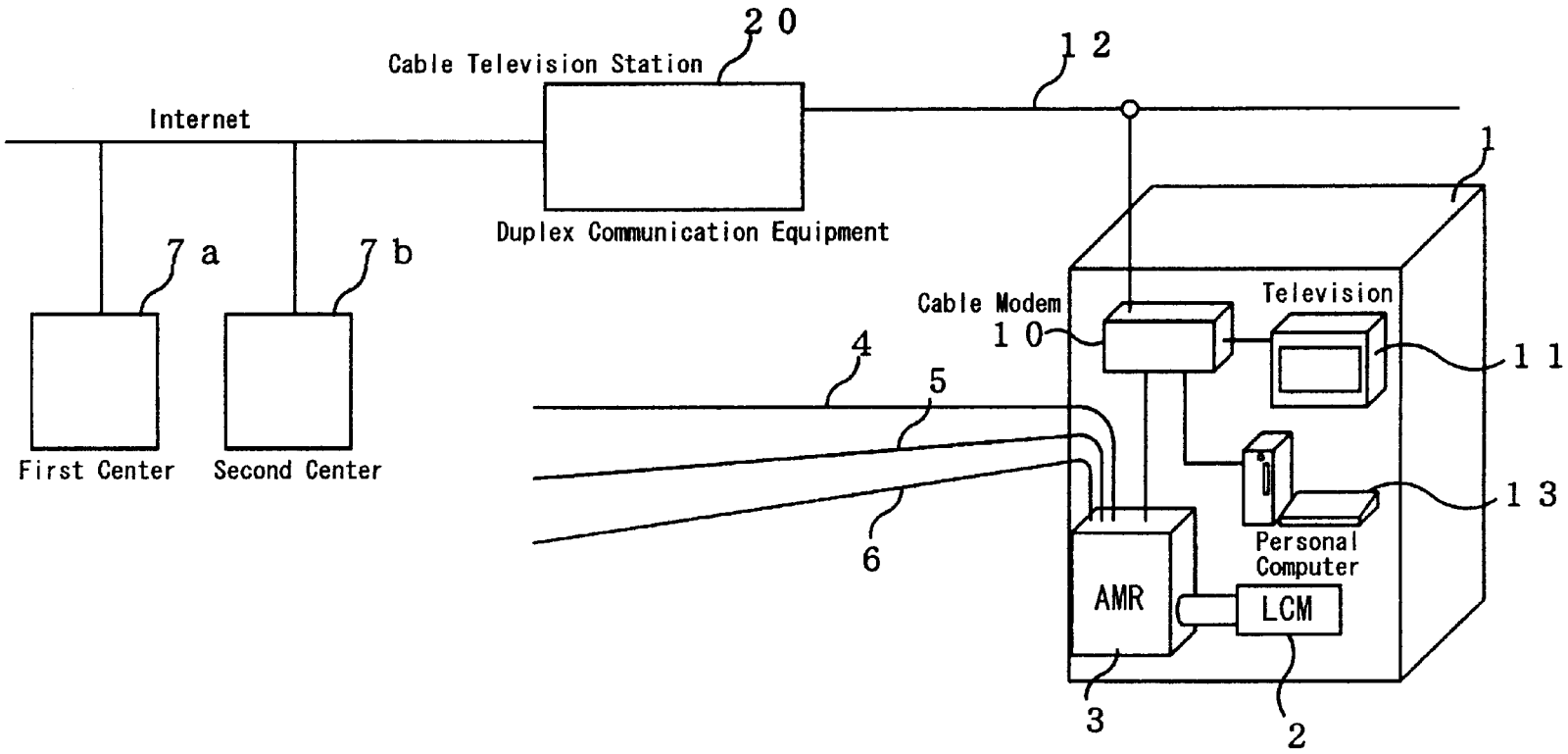
FIG. 1 is a diagram of an example of the in-home surveillance system according to the present invention.

Recently, a cable television station has developed Cable Internet that performs Internet operation via IP communication (Internet Protocol Communication). This has been achieved by connecting duplex communication equipment to a cable television network, and in each household, installing a cable modem capable of the IP communication as well as of relaying cable television broadcasts, and then connecting a personal computer to the cable modem.

This Cable Internet is becoming popular in place of IP communication that uses the telephone line, because it uses a full-time connection, and because of its high-speed and large capacity, and relatively low cost.

Based on this kind of technology, with the in-home surveillance-system of the present invention, duplex communication equipment is installed in a cable television station. Moreover, in a contracting house is installed a domestic cable modem that is connected to a lifestyle utility meter, and capable of IP communication (Internet Protocol communication) as well as relaying cable television broadcasts.

The in-home surveillance-system performs automatic reading of the lifestyle utility usage, by transmission of it from the domestic cable modem, using the above-mentioned IP communication to a first center which is connected to the internet. Moreover, the in-home surveillance-system detects the occurrence of anything unusual relating to the occupant, by full-time transmission, using the IP communication, of at least one of lifestyle utility usage, cable television broadcast reception, and internet access from the domestic cable modem to a second center which is connected to the internet.

It is desirable that the above-mentioned lifestyle utility is chosen from at least one of the integrated amount of electric energy, the integrated amount of gas flow, and the integrated amount of water flow.

The in-home surveillance-system of the invention is explained based on the drawings.

FIG. 1 is a schematic diagram showing the in-home surveillance-system.

The in-home surveillance-system of the invention comprises duplex communication equipment which is installed in a cable television station 20, an automated meter reading device (AMR: made, for example, by DX Antenna Limited) 3 which is installed in a contracting home 1 and a domestic cable modem 10 that is connected to the AMR 3 in the contracting home 1. The AMR functions as meters for the integrated amount of electric energy, the integrated amount of gas flow and the integrated amount of water flow, so as to be capable of IP communication (Internet Protocol Communication) as well as relaying cable television broadcasts. The cable television station 20 and the cable modem 10 are connected by a cable television network 12 by way of a tree-type system. With the cable modem, 10 Mbit per second to 40 Mbit per second is used for transmission from the cable television station 20 to the contracting home 1, while 10 Mbit per second or less is used for transmission from the contracting home 1 to the cable television station 20.

The in-home surveillance-system performs automatic reading of the integrated amount of electric energy, the integrated amount of gas flow and the integrated amount of water flow, by transmission from the domestic cable modem 10, using the above-mentioned IP communication, to a first center 7*a* which is connected to the Internet.

Moreover the in-home surveillance-system performs automatic detection of any unusual developments such as emergencies or illness of the occupant, by transmission from the domestic cable modem 10, using the IP communication, to a second center 7*b* which is connected to the Internet, based on at least one of the following: changes in the integrated amount of electric energy, integrated amount of gas flow or integrated amount of water flow, the situation of the cable television broadcast reception, and the situation of access to the Internet. This is conducted in full-time watching.

Communication from the cable television station 20 to the contracting home 1 is made by way of multiplexing of broad casting signals and data signals for respective frequencies.

The reception signal of the cable television broadcast is branched by the domestic cable modem 10 that is connected to the cable television network 12, and received through a cable television receiver 11. The domestic cable modem 10 uses for example a cable modem (DCM-110 made, for example, by DX Antenna Limited). The cable television receiver 11 is available on the market, and a model that is compatible with the cable television network 12 may be selected.

Access to the Internet is performed through the connection of a personal computer 13 or the like, to the cable modem 10 in the frequency band of e.g. 5 to 42 MHz from the computer and 88 to 860 MHz to the computer. For the personal computer 13, one that is available on the market may be used. Identification of each contracting house is made by separate frequency.

The AMR 3 is connected to a power line 4 to measure the integrated amount of electric energy, to a gas pipe 5 to measure the integrated amount of gas flow, and/or to a water pipe 6 to measure the integrated amount of water flow. At each predetermined period, it transmits the integrated amount of electric energy, the integrated amount of gas flow and the integrated amount of water flow to the domestic cable modem 10. The AMR 3 internalizes a measurement circuit according to known measuring methods, and performs communication with the cable modem 10 through a known circuit capable of the above-mentioned communication methods.

As for the automatic detection of the occurrence of the occupant's illness or emergency, for example, whether the integrated amount of electric energy, the integrated amount of gas flow, and the integrated amount of water flow do not increase in the automatic reading of each fixed period, and whether the cable television reception or access to the Internet is abnormally sparse, are checked. For example in the case that there are no transmissions for more than one day, the center, after checking the telephone and so forth, will inform the police or ambulance.

Alternatively, an LCM 2 (load control module) that controls the household electrical appliances may be connected to the AMR 3, and from the operational situation of the LCM 2, an unusual event relating to the occupant can be automatically detected.

The in-home surveillance-system of the invention, because it can continually use Cable Internet, and is capable of reliable automatic reading of a lifestyle utility, makes it possible to continually confirm the safety of an occupant.

As explained in detail above, the in-home surveillance-system of the invention has the remarkable effect of being able to reliably ensure the safety of an occupant, with low cost and easy maintenance.

What is claimed is:

1. An in-home surveillance-system comprising:

duplex communication equipment installed in a cable television station, a domestic cable modem installed in a contracting home and connected to a lifestyle utility meter and capable of internet protocol communication as well as relaying cable television broadcasts, means for performing automatic reading of the lifestyle utility usage by transmission of said usage from the domestic cable modem, using the internet protocol communication, to a first center which is connected to the internet, means for comparing the automatic reading of the Lifestyle utility usage against predetermined usage standards, means for determining a deviation from said predetermined usage standards by full-time transmission, using the internet protocol communication, of at least one of said lifestyle utility usage, cable television broadcast reception, and internet access from the domestic cable modem, to a second center which is connected to the internet.

2. The in-home surveillance-system of claim 1, wherein the lifestyle utility is chosen from at least one of integrated amount of electric energy, integrated amount of gas flow, and integrated amount of water flow.

3. The in-home surveillance system of claim 1, further comprising means for communicating said deviation to investigative authorities.

4. The in-home surveillance system of claim 3, wherein said communicating means further comprising contacting police or medical assistance.

5. An in-home surveillance system comprising:

communication means located in a home and connected to a first monitoring means via duplex communication equipment, a utility usage monitor connected to said communication means, said communication means adapted for transmitting utility usage to said first monitoring means, determining means provided in said monitoring means for comparing said transmitted utility usage with predetermined usage standards and for determining a deviation in utility usage, and means for communicating said deviation to a second monitoring means.

6. The in-home surveillance system of claim 5, wherein said first monitoring means is located outside the home.

7. The in-home surveillance system of claim 6, wherein said second monitoring means is located outside the home.

8. The in-home surveillance system of claim 5, wherein said communication means is a cable modem and said duplex communication equipment is located in a cable television station.

9. The in-home surveillance system of claim 8, wherein communication between said communication means and said first and second monitoring means occurs over the internet.

10. The in-home surveillance system of claim 5, wherein said utility usage monitor monitors usage of at least one of gas flow, electric energy usage and water flow.

11. The in-home surveillance system of claim 9, further comprising a revelation connected to said communication means and a computer connected to said communication means, and wherein said utility usage monitor monitors usage of at least one of gas flow, electric energy usage, and water flow, and wherein said communication means is further adapted to transmit cable usage by said television and internet access by said computer to said first monitoring means.

12. The in-home surveillance system of claim 11, wherein said utility usage monitor monitors usage of all of gas flow, electric energy usage, and water flow.

13. The in-home surveillance system of claim 5, wherein said second monitoring means further comprises means for communicating said deviation to investigative authorities.

14. The in-home surveillance system of claim 13, wherein said deviation communicating means further comprising contacting police or medical assistance.

* * * * *